US005094183A

United States Patent [19]

Hamasaki

[11] Patent Number: 5,094,183

[45] Date of Patent: Mar. 10, 1992

[54] ROTATING APPARATUS FOR COATED WORK

[75] Inventor: Masahiro Hamasaki, Houfu, Japan

[73] Assignee: Nishikawa Kasei Co., Ltd., Hiroshima, Japan

[21] Appl. No.: 585,682

[22] Filed: Sep. 20, 1990

[30] Foreign Application Priority Data

Apr. 16, 1990 [JP] Japan ..... 2-97552

[51] Int. Cl.[5] ..... B05C 13/00; B05C 13/02

[52] U.S. Cl. ..... 118/56; 118/53; 118/500; 118/320

[58] Field of Search ..... 118/56, 500, 320, 323, 118/53; 427/240, 346

[56] References Cited

U.S. PATENT DOCUMENTS 907,365 12/1908 Huebner ..... 118/56
2,658,008 11/1953 Williams ..... 118/56
3,724,283 4/1973 Hutchison ..... 74/99 R
3,749,058 7/1973 Slabaugh ..... 118/53
4,874,639 10/1989 Matsui et al. ..... 118/56

FOREIGN PATENT DOCUMENTS 1058630 12/1983 U.S.S.R. ..... 118/56

*Primary Examiner*—Richard V. Fisher
*Assistant Examiner*—Brenda Lamb
*Attorney, Agent, or Firm*—Wegner, Cantor, Mueller & Player

[57] ABSTRACT

A coated work rotating apparatus is disclosed which dries paint on a coated work while rotating the coated work after completion of coating. The coated work rotating apparatus comprises a carrier frame transported in one direction by a transport mechanism, a rotary frame mounted for rotation around a first axis on the carrier frame, and a coated work holding member mounted for rotation around a second axis perpendicular to the first axis on the rotary frame. A rotational driving mechanism rotates the rotary frame with respect to the carrier frame and also rotates the coated work holding member with respect to the rotary frame. By mounting a coated work on the rotating apparatus, smooth coated faces having a good appearance can be obtained for all faces of the coated work.

7 Claims, 5 Drawing Sheets

ROTATING APPARATUS FOR COATED WORK

BACKGROUND OF THE INVENTION

This invention relates to a coated work rotating apparatus for rotating a coated work such as a bumper for an automobile during drying of a coated film of paint on the work.

In order to provide high grade feeling to an automobile, a degree of coating of a body of the automobile is a very important factor, and various coating techniques have been developed to increase high grade feeling together with improvement in efficiency of coating by individual automobile makers. Also for a bumper, a collapsible bumper made of a synthetic resin is employed in place of a conventional bumper made of sheet metal, and coating is applied to such bumper to increase the high grade feeling of the automobile. A coating process of a bumper made of a synthetic resin generally includes a washing step, a masking step, an undercoating and drying step, and a final coating and drying step.

In order to maintain a quality of coating, it is important to minimize causes of failure in coating. One of causes of failure in coating is a sagging of paint which takes place when a vertical face or an inclined face of a work is coated. As one of causes of such sagging, the thickness of a film of paint is excessively great or the viscosity of paint is excessively low, and if part of paint flows down over several millimeters, then the film of the paint will be swollen and form a sagging mark at a location at which such flow of the paint stops. As countermeasures for preventing a sagging of paint, various methods may be available including, for example, to decrease the thickness of a film of paint, to increase the viscosity of paint and to accelerate drying of paint. Also rotating a coated work for a predetermined period of time immediately after coating of the work is an effective method for preventing the sagging of paint.

For example, U.S. Pat. No. 4,874,639 discloses, under the title of coating method and apparatus on a coating line, a technique of rotating a body of an automobile while transporting the automobile body by means of a transport truck. And, Japanese Laid-Open Patent Publication No. 64-63075 discloses a coating process which includes a drying and baking step wherein a body for an automobile is rocked while it is being rotated.

The techniques disclosed in U.S. Pat. No. 4,874,639 and Japanese Laid-Open Patent Publication No. 64-63075 mentioned above, however, do not provide satisfactory finish of coating because a sagging of paint sometimes takes place due to the fact that all of coated faces of a work are not directed upwardly during rotation of the coated work.

SUMMARY OF THE INVENTION

Accordingly, it is an object of the present invention to provide a rotating apparatus for a coated work which can rotate, with a simple construction, an elongated coated work such as a bumper to direct all of coated faces of the work upwardly in a horizontal condition to provide beautiful finish of coating of all faces of the work.

In accordance with an aspect of the present invention, there is provided a coated work rotating apparatus for drying paint on a coated work while rotating the coated work after completion of coating, comprising transport means; a carrier frame transported in one direction by the transport means; a rotary frame mounted for rotation around a first axis on the carrier frame; a coated work holding member mounted for rotation around a second axis perpendicular to the first axis on the rotary frame; and rotational driving means for rotating the rotary frame around the first axis and the coated work holding member around the second axis.

Preferably, the rotational driving means includes means for converting linear motion of the transport means into rotational motion, first transmitting means for transmitting such rotational motion to the rotary frame, and second transmitting means for transmitting the rotational motion to the coated work holding member.

The above and other objects, features and advantages of the present invention and the manner of realizing them will become more apparent, and the invention itself will best be understood, from a study of the following description and appended claims with reference had to the attached drawings showing some preferred embodiments of the invention.

DESCRIPTION OF THE PREFERRED EMBODIMENTS

In the following, preferred embodiments of the present invention will be described in detail with reference to the drawings.

Figure 1:
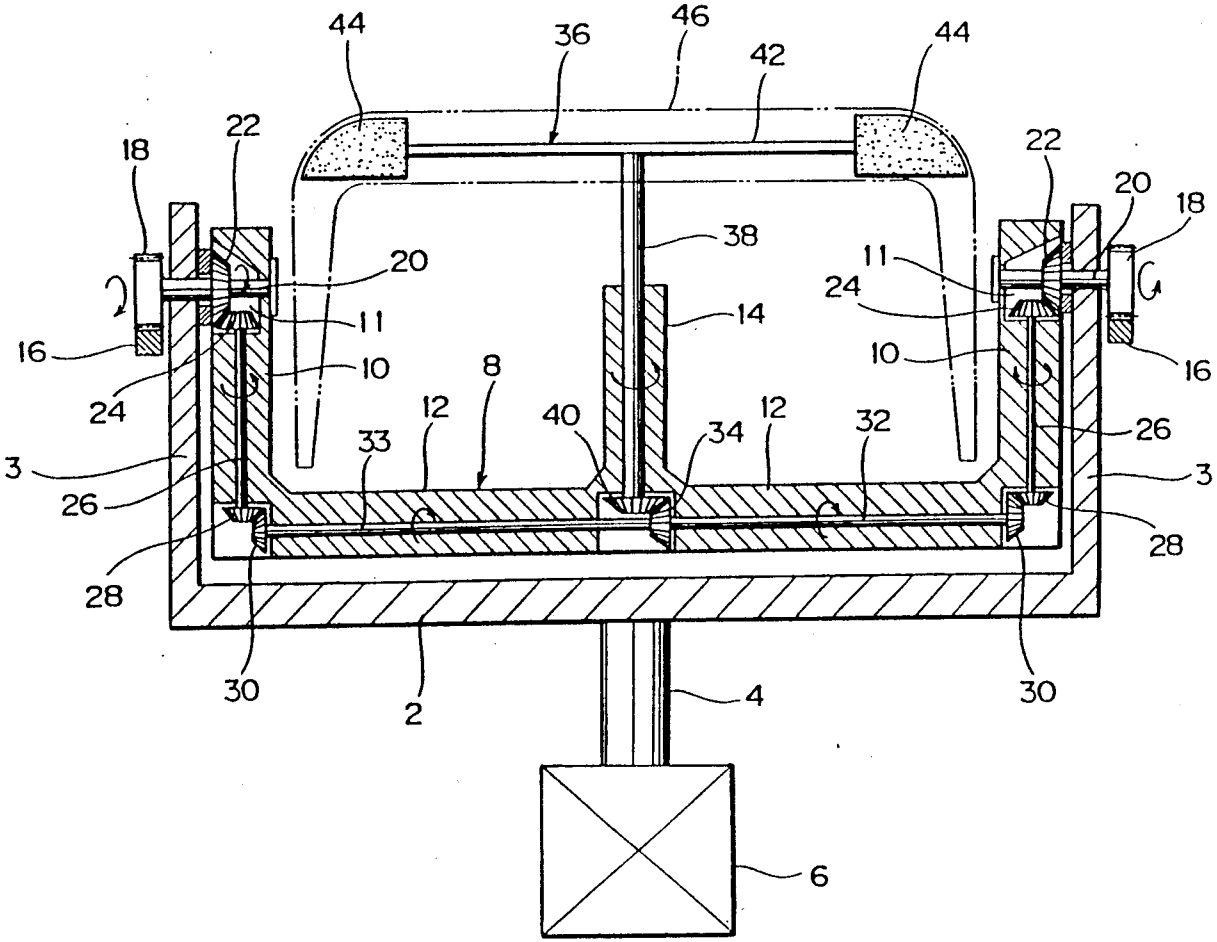
FIG. 1 is a perspective view of a coated work rotating apparatus showing an embodiment of the present invention.

Referring first to FIG. 1, there is shown a sectional view of a coated work rotating apparatus according to an embodiment of the present invention. Since the coated work rotating apparatus of the present embodiment has substantially left and right symmetrical construction, corresponding left and right elements are denoted by like reference numerals. The coated work rotating apparatus includes a carrier frame 2 having a substantially channel-shaped or C-shaped cross section and connnected by means of a connecting member 4 to a transport mechanism 6 which may be constructed including a conveyor and so forth. A rotary frame 8 is mounted for rotation at ends of a pair of arm portions 3 on the opposite left and right ends of the carrier frame 2 by means of a pair of shafts 20. The rotary frame 8 includes a pair of end members 10 and a transverse member 12 connecting the end members 10 in an integral relationship to each other, and the transverse member 12 has a mounting portion 14 formed in an integral relationship substantially at a central portion thereof so as to extend in the same direction as the end members 10 such that the rotary frame 8 has a substantially E-shaped profile.

A pair of racks 16 extend in the direction of transportation by the transport mechanism 6, and a pinion 18 is held in meshing engagement with each of the racks 16. The pinions 18 are securely mounted individually at ends of the shafts 20 the other ends of which are securely mounted on the end members 10 of the rotary frame 8. Further, the shaft 20 are individually mounted for rotation on the arm portions 3 of the carrier frame 2 each by means of a bearing not shown. A bevel gear accommodating portion 11 is defined in each of the end members 10 of the rotary frame 8, and a bevel gear 22 welded to the corresponding arm portion 3 of the carrier frame 2 is disposed in the bevel gear accommodating portion 11 while the corresponding shaft 20 is fitted for rotation around the bevel gear 22. When the carrier frame 2 is transported to the side of the plane of FIG. 1 by the transport mechanism 6, the pinions 18 are rotated in the directions indicated by individual arrow marks in FIG. 1 so that the transverse member 12 of the rotary frame 8 is rotated toward the other side of the plane of FIG. 1 around the shafts 20. Since another bevel gear 24 securely mounted at an end of a connecting shaft 26 supported for rotation in the corresponding end member 10 of the rotary frame 8 is held in meshing engagement with a corresponding one of the bevel gears 22 which are secured to the arm portions 3 of the carrier frame 2, when the rotary frame 8 is rotated toward the other side of the plane of FIG. 1, the bevel gears 24 and the connecting shafts 26 are rotated in the directions indicated by individual arrow marks in FIG. 1, and also further bevel gears 28 securely mounted at the other ends of the connecting shafts 26 are rotated in the individually same directions. Each of the bevel gears 28 is held in meshing engagement with a bevel gear 30 securely mounted at an end of a first connecting shaft 32 or a second connecting shaft 33 supported for rotation in the transverse member 12 of the rotary frame 8. Meanwhile, a bevel gear 34 is securely mounted at the other end of the first connecting shaft 32 while the other end of the second connecting shaft 33 is connected to the bevel gear 34. Accordingly, when the bevel gears 24 and 28 and connecting shafts 26 are rotated in the directions indicated by the individual arrow marks in FIG. 1, then the bevel gears 30 and 34 and first and second connecting shafts 32 and 33 are rotated in the directions indicated by individual arrow marks in FIG. 1.

A support shaft 38 of a coated work holding member 36 is received for rotation in the mounting portion 14 provided substantially at the center of the rotary frame 12, and a bevel gear 40 is securely mounted at an end of the support shaft 38 and held in meshing engagement with the bevel gear 34. Accordingly, when the first and second connecting shafts 32 and 33 are rotated in the directions indicated by the individual arrow marks in FIG. 1, the support shaft 38 is rotated in the counterclockwise direction as indicated by an arrow mark in FIG. 1. The other end of the support shaft 38 is securely connected to a central portion of a transverse rod 42, and a pair of holding pads 44 are mounted at the opposite ends of the transverse rod 42. A coated work such as a bumper 46 is held by the holding pads 44 as shown in phantom in FIG. 1.

Since the coated work rotating apparatus of the present embodiment is constructed in such a manner as described above, when the carrier frame 2 is transported to this side of the plane of FIG. 1 by the transport mechanism 6, the rotary frame 8 is rotated toward the other side of the plane of FIG. 1 while at the same time the coated work holding member 36 is rotated in the counterclockwise direction in FIG. 1.

Figure 2:
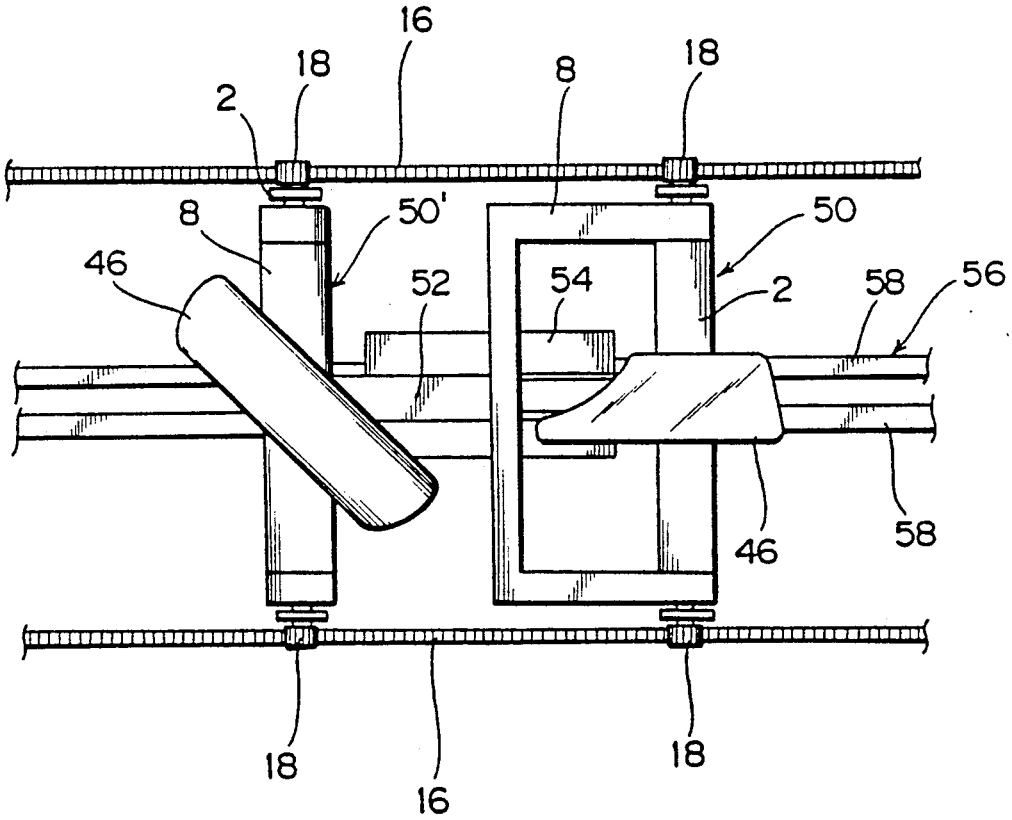
FIG. 2 is a plan view of two such coated work rotating apparatus of FIG. 1 connected to each other showing another embodiment of the present invention.
Figure 3:
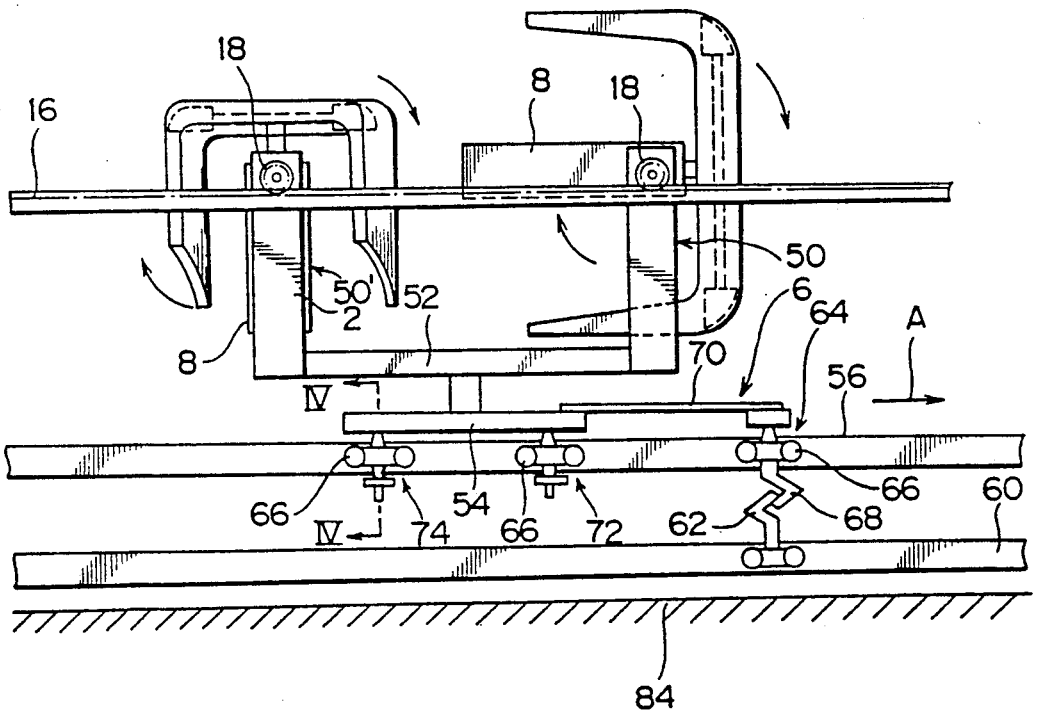
FIG. 3 is a side elevational view of the arrangement of FIG. 2 with a bumper omitted.

Referring now to FIGS. 2 and 3, there are shown a schematic plan view and a schematic side elevational view of an arrangement according to another embodiment of the present invention wherein a pair of coated work holding apparatus 50 and 50' having a similar construction to that of the coated work rotating apparatus described above are connected in an integral relationship to each other by means of a connecting member 52. In the following description of the arrangement, substantially like elements to those of the coated work holding apparatus of the embodiment described above are denoted by like reference numerals and description thereof is omitted herein to avoid redundancy. Further, in the side elevational view of FIG. 3, a bumper 46 is omitted for the clarification of illustration. The coated work holding apparatus 50 and 50' are connected in an integral relationship to each other by means of the connecting member 52 and carried on a truck 54. The truck 54 is guided for movement in the direction indicated by an arrow mark A in FIG. 3 along a guide rail 56 which is formed from a pair of rail members 58 as shown in FIG. 4 and has such construction as described below.

Referring to FIG. 3, the arrangement shown includes a chain 60 on which a dog 62 is mounted. A traction roller unit 64 having four rollers 66 mounted thereon is fitted on the guide rail 56 so that it may be guided by the latter. The traction roller unit 64 has a dog 68 provided thereon for engagment with the dog 62 on the chain 60. The traction roller unit 64 is connected to the truck 54 by way of a connecting member 70. A pair of roller units 72 and 74 each having similar construction to that of the traction roller unit 64 are mounted on the truck 54, and each of the roller units 72 and 74 is constructed including four rollers 66 and is fitted on and guided by the guide rail 56. Reference numeral 84 denotes a floor, and the chain 60 is driven to circulate by way of a motor, a sprocket wheel and so forth not shown.

Figure 4:
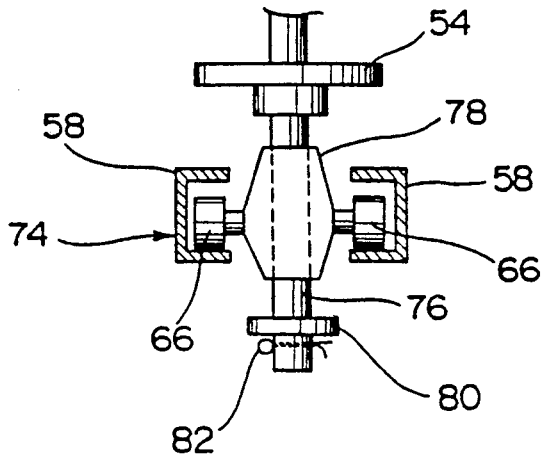
FIG. 4 is an enlarged sectional view taken along line IV—IV of FIG. 3.

FIG. 4 is an enlarged sectional view taken along line IV—IV of FIG. 3 and shows detailed structure of the roller unit 74. The roller unit 74 includes a mounting member 78 fitted for sliding movement on a shaft 76 secured to a lower end of the truck 54, and four rollers 66 are mounted for rotation on the mounting member 78. The rollers 66 are fitted in and guided by the rail member 58. A ring plate 80 is fitted on the shaft 76 from the lower end side of the shaft 76, and a pin 82 is inserted into an end portion of the shaft 76 to prevent coming off of the ring plate 80 from the shaft 76.

Figure 5:
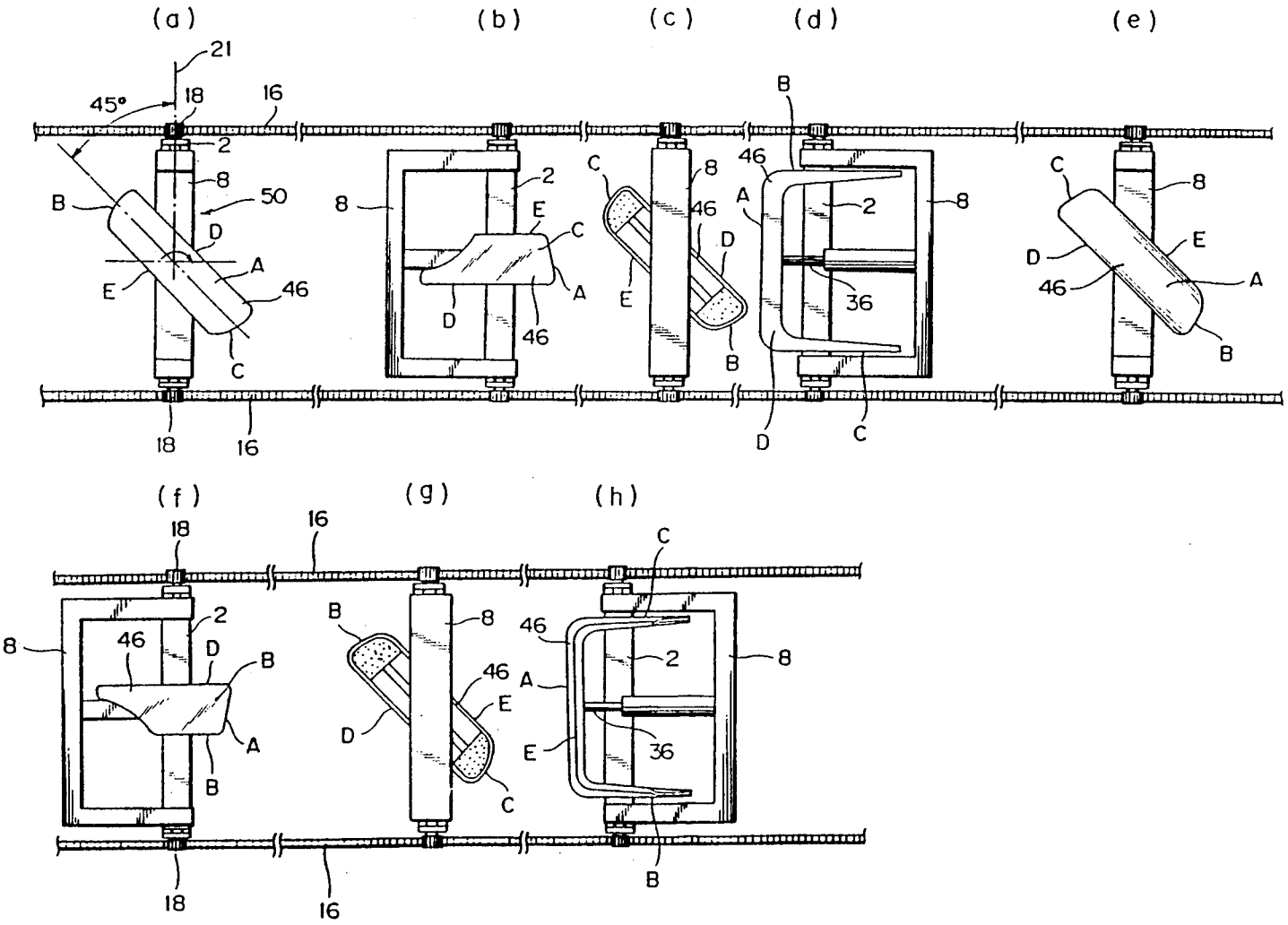
FIG. 5 is an illustrative view showing different steps of operation of the coated work rotating apparatus of FIG. 1.

Operation of the coated work rotating apparatus of the embodiments described above will be described subsequently with reference to FIG. 5. In FIG. 5, the coated work rotating apparatus 50 is shown transported in the rightward direction to rotate a bumper 46. However, also the arrangment shown in FIG. 2 wherein the two coated work rotating apparatus 50 and 50' are connected to each other operates in a similar manner (a) of FIG. 5 shows an original position of a cycle of rotation of a bumper 46. In particular, the rotary frame 8 extends downwardly in a plane perpendicular to the racks 16, with ends of the arm portions 3 thereof directed upwardly, and the bumper 46 is held on the coated work holding member 36 in such a horizontal posture that a front face A thereof is directed upwardly and the bumper 46 is inclined by 45 degrees from an axial line 21 of rotation of the rotary frame 8. In order to make it clear in what manner the bumper 46 is rotated, the front face, a right-hand side face, a left-hand side face, a top face and a bottom face of the bumper 46 are hereinafter referred to as faces A, B, C, D and E, respectively. The ratio between rotations of the rotary frame 8 and the coated work holding member 36 is set to 1:1.5, and in the condition shown in (a) of FIG. 5, the rotational angles of the rotary frame 8 and coated work holding member 36 are assumed both 0 degrees.

When the coated work holding apparatus 50 is transported in the rightward direction to the position shown in (b) of FIG. 5, the rotary frame 8 is rotated by 90 degrees (one fourth rotation) in the clockwise direction from the posture shown in (a) of FIG. 5. In this instance, the coated work holding member 36 is rotated by 135 degrees (0.375 rotations) to a position at which the left-hand side face C of the bumper 46 is directed upwardly in a horizontal condition. (c) of FIG. 5 shows a condition after the rotary frame 8 is rotated by 180 degrees (one half rotation), and in this instance, the coated work holding member 36 is rotated by 270 degrees (0.75 rotation) to a position at which the rear face of the bumper 46 is directed upwardly. When the bumper 46 is transported further to a position shown in (d) of FIG. 5, the rotary frame 8 is rotated by 270 degrees (three fourths rotations) while the rotary frame 8 is rotated by 405 degrees (1.125 rotations), and consequently, the top face D of the bumper 46 is directed upwardly in a horizontal condition. When the bumper 46 is further transported to a position shown in (e) of FIG. 5, the rotary frame 8 is rotated by 360 degrees (one full rotation) while the coated work holding member 36 is rotated by 540 degrees (1.5 rotations), and consequently, the front face A of the bumper 46 is directed upwardly again in a horizontal condition.

(f) of FIG. 5 shows a condition after the rotary frame 8 is rotated by 450 degrees (1.25 rotations), and in this instance, since the coated work holding member 36 is rotated by 675 degrees (1.875 rotations), the right-hand side face B of the bumper 46 is directed upwardly in a horizontal condition. When the bumper 46 is further transported to a position shown in (g) of FIG. 5, the rotary frame 8 is rotated by 540 degrees (1.5 rotations) and the coated work holding member 36 is rotated by 810 degrees (2.25 rotations), and consequently, the rear face of the bumper 46 is directed upwardly again. Then, when the bumper 46 is transported further to a position shown in (h) of FIG. 5, the rotary frame 8 is rotated by 630 degrees (1.75 rotations) and the coated work holding member 36 is rotated by 945 degrees (2.625 rotations), and consequently, the bottom face E of the bumper 46 is directed upwardly in a horizontal condition. When the bumper 46 is further transported until the rotary frame 8 is rotated by 720 degrees (2 rotations) and the coated work holding member 36 is rotated by 1,080 degrees (3 rotations), the bumper 46 is returned to the original position shown in (a) of Fig. 5 in which the front face A of the bumper 46 is directed upwardly in a horizontal condition. After then, since the bumper 36 is rotated while repeating the conditions of (a) to (h) of FIG. 5, paint (coated films) on all faces of the bumper 46 can be dried almost uniformly while each face of the bumber 46 is directed upwardly in a horizontal condition. As a result, all of the coated faces of the bumper can be finished in a good appearance.

Figure 6:
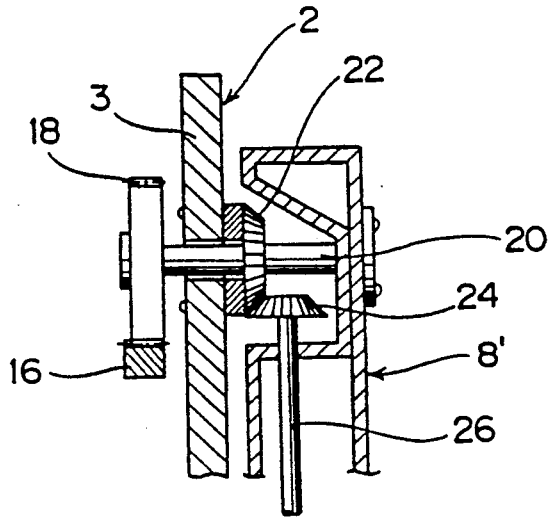
FIG. 6 is a sectional view of another coated work rotating apparatus showing a further embodiment of the present invention wherein a rotary frame is formed from a metal sheet.

While in the embodiments described above the rotary frame 8 is formed from a solid member, it is also possible to form such rotary frame otherwise as a rotary frame 8' made of sheet metal as shown in FIG. 6. Where the rotary frame 8' is formed from a metal sheet in this manner, it is advantageous for rotation of the same because the weight is comparatively low.

Further, while in the embodiments described above transporting force of the chain 60 is utilized for rotational driving means for the rotary frame 8 and coated work holding member 36, the rotational driving means in the present invention is not limited to this, and for example, a driving source such as a motor and a power transmitting mechanism for rotating the rotary frame 8 and coated work holding member 36 simultaneously may be provided separately while the carrier frame 2 is provided fixedly.

Further, in the embodiment of FIG. 1, it is possible to omit the driving force transmitting mechanism in the left-hand side half of FIG. 1 while the rotary frame 8 and coated work holding member 36 are rotated by the driving mechanism in the right-hand side half of FIG. 1 and the bevel gear 40. In this instance, the left-hand side end member 10 of the rotary frame 8 is supported for rotation only on the arm portion 3 of the carrier frame 2.

As described so far, according to the present invention, since all of coated faces of a work can be directed upwardly and the direction of the force of gravity acting upon a coated film of paint can be changed continuously by rotating the coated work for a predetermined period of time after coating, a possible sagging of paint can be prevented effectively, and consequently, smooth coated faces having a good appearance can be obtained for all faces of the work.

What is claimed is:

1. A coated work rotating apparatus for drying paint on a coated work while rotating the coated work after completion of coating, comprising:

a carrier frame;

transport means for transporting said carrier frame in one direction;

a rotary frame mounted for rotation around a first axis on said carrier frame;

a coated work holding member mounted for rotation around a second axis perpendicular to said first axis on said rotary frame; and rotational driving means for simultaneously rotating said rotary frame around the first axis and said coated work holding member around the second axis.

2. A coated work rotating apparatus according to claim 1, wherein said coated work holding member has a substantially T-shaped profile and said rotary frame has a substantially E-shaped profile wherein a pair of end members are connected in an integral relationship to each other by a transverse member while a mounting portion is provided substantially at a central portion of said transverse member and extends in an integral relationship in the same direction as said end members, and wherein said coated work holding member is mounted for rotation at said mounting portion of said rotary frame and rotated by said rotational driving means.

3. A coated work rotating apparatus according to claim 2, wherein the coated work is a bumper of a substantially C-shaped profile, and the bumper is mounted on said coated work holding member such that an outer face of a side portion thereof is opposed to the inside of the end members of said rotary frame and a longitudinal outer face thereof is positioned remote from said rotary frame.

4. A coated work rotating apparatus according to claim 1, wherein the ratio between rotations of said rotary frame and said coated work holding member is set to 1:1.5.

5. A coated work rotating apparatus for drying paint on a coated work while rotating the coated work after completion of coating, comprising:

a carrier frame;

transport means for transporting said carrier frame in one direction;

a rotary frame mounted for rotation around a first axis on said carrier frame;

a coated work holding member mounted for rotation around a second axis perpendicular to said first axis on said rotary frame; and rotational driving means for simultaneously rotating said rotary frame around the first axis and said coated work holding member around the second axis, said rotational driving means including means for converting linear motion of said transport means into rotational motion, first transmitting means for transmitting such rotational motion to said rotary frame, and second transmitting means for transmitting the rotational motion to said coated work holding member.

6. A coated work rotating apparatus according to claim 5, wherein said converting means includes a rack extending along the transporting direction, and a pinion for engaging with said rack.

7. A coated work rotating apparatus according to claim 5, wherein said second transmitting means includes a plurality of rotary shafts received for rotation in said rotary frame, and a plurality of gears securely mounted on said rotary shafts.

* * * * *